US008561519B2

(12) United States Patent
Karakookly

(10) Patent No.: US 8,561,519 B2
(45) Date of Patent: Oct. 22, 2013

(54) MULTI-WEAPONS SYSTEM

(75) Inventor: Yuval Karakookly, Modiin (IL)

(73) Assignee: Israel Military Industries, Ltd., Ramat Hasharon (IL)

( * ) Notice: Subject to any disclaimer, the term of this patent is extended or adjusted under 35 U.S.C. 154(b) by 0 days.

(21) Appl. No.: 13/496,351

(22) PCT Filed: Sep. 16, 2010

(86) PCT No.: PCT/IL2010/000766
§ 371 (c)(1),
(2), (4) Date: May 30, 2012

(87) PCT Pub. No.: WO2011/033514
PCT Pub. Date: Mar. 24, 2011

(65) Prior Publication Data

US 2012/0247317 A1 Oct. 4, 2012

(30) Foreign Application Priority Data

Sep. 17, 2009 (IL) ..... 201051

(51) Int. Cl.
*F41C 27/00* (2006.01)

(52) U.S. Cl.
USPC ..... 89/127; 89/40.03; 89/40.04; 89/41.02; 89/41.18

(58) Field of Classification Search
USPC ..... 89/37.01, 40.03, 40.04, 41.02, 41.03, 89/41.16, 41.18, 127, 126
See application file for complete search history.

(56) References Cited

U.S. PATENT DOCUMENTS

| | | | | |
|---|---|---|---|---|
| 7,086,318 | B1 | 8/2006 | Darnall | |
| 7,185,575 | B1 | 3/2007 | Collier et al. | |
| 7,202,809 | B1 | 4/2007 | Schade et al. | |
| 7,669,513 | B2 * | 3/2010 | Niv et al. | 89/40.03 |
| 2003/0051599 | A1 * | 3/2003 | Lundqvist et al. | 89/37.03 |
| 2012/0217301 | A1 * | 8/2012 | Namey et al. | 235/411 |
| 2013/0042749 | A1 * | 2/2013 | Iardella | 89/41.02 |

FOREIGN PATENT DOCUMENTS

| | | | |
|---|---|---|---|
| DE | 102006034688 | A1 | 1/2008 |
| EP | 1493942 | A1 | 1/2005 |
| WO | WO-2005033611 | A1 | 4/2005 |

OTHER PUBLICATIONS

International Search Report.

* cited by examiner

*Primary Examiner* — J. Woodow Eldred
(74) *Attorney, Agent, or Firm* — Harness, Dickey & Pierce, P.L.C.

(57) ABSTRACT

A multi-weapons system comprising: an active defense system (ADS) comprising a mortar launch tube mounted on a support base-plate rotatable 360 degrees; a weapons system comprising a machine gun mounted alongside the active defense system (ADS) on the support base, a motor with mechanism to rotate the support base-plate with the active defense system (ADS) 360 degrees, drive means to adjust the power capacity of the motor between that required for the active defense system and that required for the machine gun, control means to rotate and adjust the elevation of the launch tube and adjust the directional movement of the machine gun, computer and electronic means to automatically rotate and fire the active defense system display and control means to manually operate the machine gun, control means to override the manual operation of the machine gun and prevent its firing when the active defense system is automatically activated.

16 Claims, 5 Drawing Sheets

MULTI-WEAPONS SYSTEM

FIELD OF THE INVENTION

The present invention relates generally to a military defence system. More particularly, the present invention relates to a multi-weapons system consisting of a fast acting active protection systems designed to defeat RPG (rocket propelled grenade) threats fired from close range and a conventional weapons system such as a machine gun.

The present invention is primarily suitable for military operations carried out in urban environments with light vehicles, and mainly for threats that are fired from very close ranges where there very little time to locate, respond and destroy the threat. The multi-weapons system according to this invention is mountable on top of the light vehicles and provides fast rotational speed despite the weight and high inertia of the multi-weapon system.

BACKGROUND OF THE INVENTION

When a military operation is carried out in an urban environment, or in an ambush situation, RPGs (rocket propelled grenades) can be fired from very close range. This means that there is very little travel time between the position of the RPG to the targeted personnel, and thus very little time for the targeted personnel to locate, respond to, and destroy the threat. An explosive countermunition can be used to rapidly engage the incoming threat; however, explosives significantly increase the risk of fratricide. Several active protection systems are in various stages of development and fielding. These include DROZD and ARENA from Russia, Trophy from Israel, Diehl's AWiSS from Germany and NTAPS, SLID from the US as well as US Army Stryker®, which is a light armoured vehicle. These systems have different characteristics, benefits, and drawbacks. DROZD is an explosive close-in countermeasure system firing from fixed tubes and offering limited coverage. ARENA is another close-in system also firing from fixed positions, with better coverage than DROZD but posing a high integration burden due to system size. Trophy is small, fast, has gimbals, and offers wide coverage, but is not multi-shot capable and its explosive may pose problems for a light skinned vehicle. Diehl's system uses a fragmenting grenade with a fairly inflexible timing scheme. NTAPS uses a tracking radar, gimbaled launcher, and rocket countermeasure with a total time line too slow for close-in RPG threats.

US Army Stryker® is a light armoured vehicle with a multi-weapons system including a missile mounted atop its roof. Due to the ample weight and the high inertia of the missile, the base-plate on top of which the missile is mounted has a relatively slow rotational speed. A slow rotational speed is acceptable in this case, as the US Army Stryker® is primarily usable in military operations carried out in open environments, and mainly for threats that are fired from far ranges.

U.S. Pat. No. 7,185,575 describes a system for remote tracking of a tactical missile assembly orientation during targeting and leading to launch from a platform, including a weapon station frame rotatably attached to the platform and a command launch unit attached to the weapon station frame. This system is suitable for heavy military vehicles, such as tanks, since it is very heavy and the missile assembly is an offensive system designed to attack targets such as enemy tanks.

U.S. Pat. No. 7,202,809 proposes to overcome the deficiencies of the dynamic protection systems for heavy military vehicles, designed to primarily counteract missile threats.

The '809 patent describes a fast-acting dynamic protection system for light military vehicles defeating RPG (rocket propelled grenade) threats fired from close range. The system minimizes the hazard to troops and civilians nearby. The system uses a plurality of passive sensors to locate the threat and initialize the system. The countermunition used may be one of several choices, with the requisites being that the countermunition provides fast response with low inertia, and is able to damage or destroy the detected threat. A multi-barrel recoilless gun is the weapon of choice. A launching device is used to deploy and aim the countermunition and the tracking means. On board software and electronics are used to control the system.

SUMMARY OF THE INVENTION

It is an object of the present invention is to provide a multi-weapons system which includes an active defence system (ADS) and a conventional weapons system (machine gun) mounted on a single rotatable base-plate. The ADS can be rotated at very high speed and the machine gun can be rotated at a slow speed for maneuvering.

It is a further object of the present invention to provide a protection system that has a very short reaction time in order to successfully defeat RPG and similar threats coming from close-in and in a short-time.

Yet another object of the present invention to provide a system that minimizes the fratricide risk to personnel compared to other active protection systems while still being effective against the threat.

Still another object of the present invention is to provide a system that utilizes infrared and laser warning sensors.

The present invention is directed to a fast acting multi-weapons system that is mountable atop the roof of light military vehicles such as jeeps, hummers and light tactical vehicles.

The multi-weapons system comprises an active defence system and a machine gun mounted on a single base-plate rotatable at high speeds with respect of the ADS, and at relative low speed for rotating the machine gun.

As noted earlier, a system such as this which combines an active defence system and a machine gun on the same rotating platform has an acentric center of gravity possessing relatively high inertia (about 3 times greater than the inertia of the ADS systems alone. Due to the high inertia, one would assume that the response time and the rotational speed of the base-plate with the acentric load would be relatively slow. However, in accordance with the present invention, the unique design (as will be explained below) of the system is such that the system's base-plate can be controlled to rotate at high speed regardless of the high inertia, to give instant reaction (instant response) in the range of milliseconds with respect of the ADS system, and to rotate slowly to enable the machine gun to be maneuvered.

Further important features of the multi-weapons system of the invention include the use of a mortar-like ADS that is launched without having any rear effect such as the release of hot exhaust gases, smoke and fragments, and is small in dimension, and the addition of a conventional weapons system, such as a machine gun, on the same platform. When a threat is detected the platform is rotated very fast to face the threat and the mortar interceptor is launched, while not affecting the stability of the light vehicle on which the system is mounted. There is no danger of the vehicle turning over.

The speed at which the platform can be rotated is sufficient to allow interception of a threatening projectile fired at a distance of 30 meters or more from the vehicle.

In accordance with this invention light military vehicles are light tactical military vehicles of 4 to 15 tons, for example, hummers, jeeps and some troop carriers.

BRIEF DESCRIPTION OF THE INVENTION

The invention will be better understood when considered in conjunction with the drawings that follow.

DETAILED DESCRIPTION OF THE INVENTION

Figure 1:
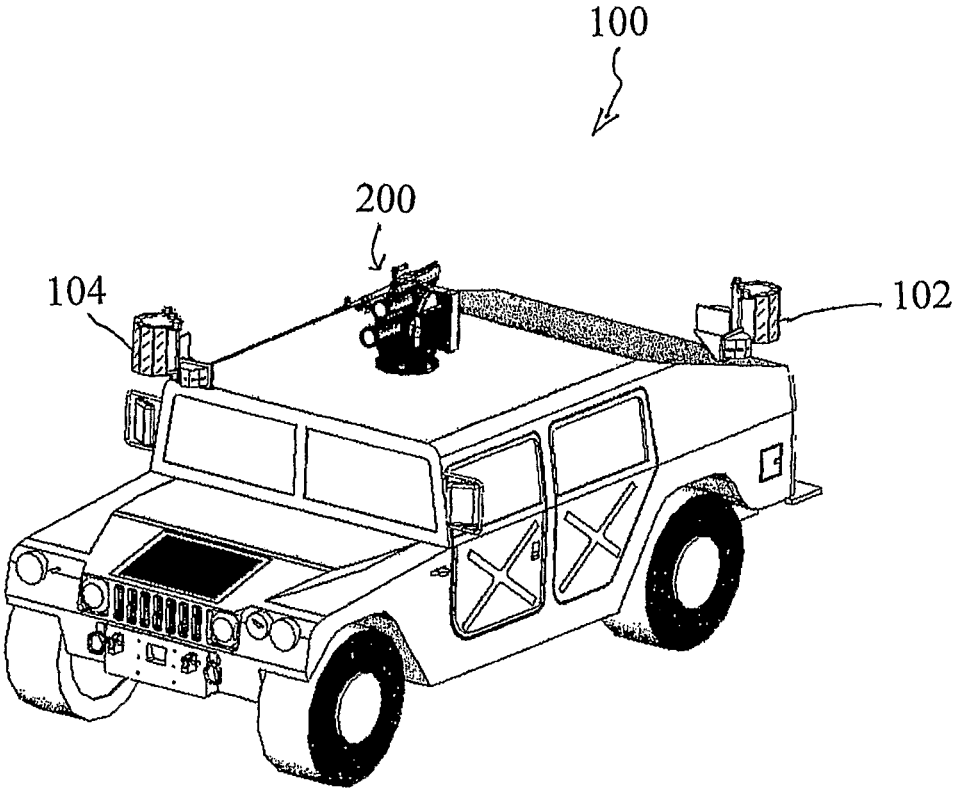
FIG. 1 illustrates a light weight military vehicle having mounted thereon a multi-weapons system in accordance with the present invention.
Figures 2, 3, 4:
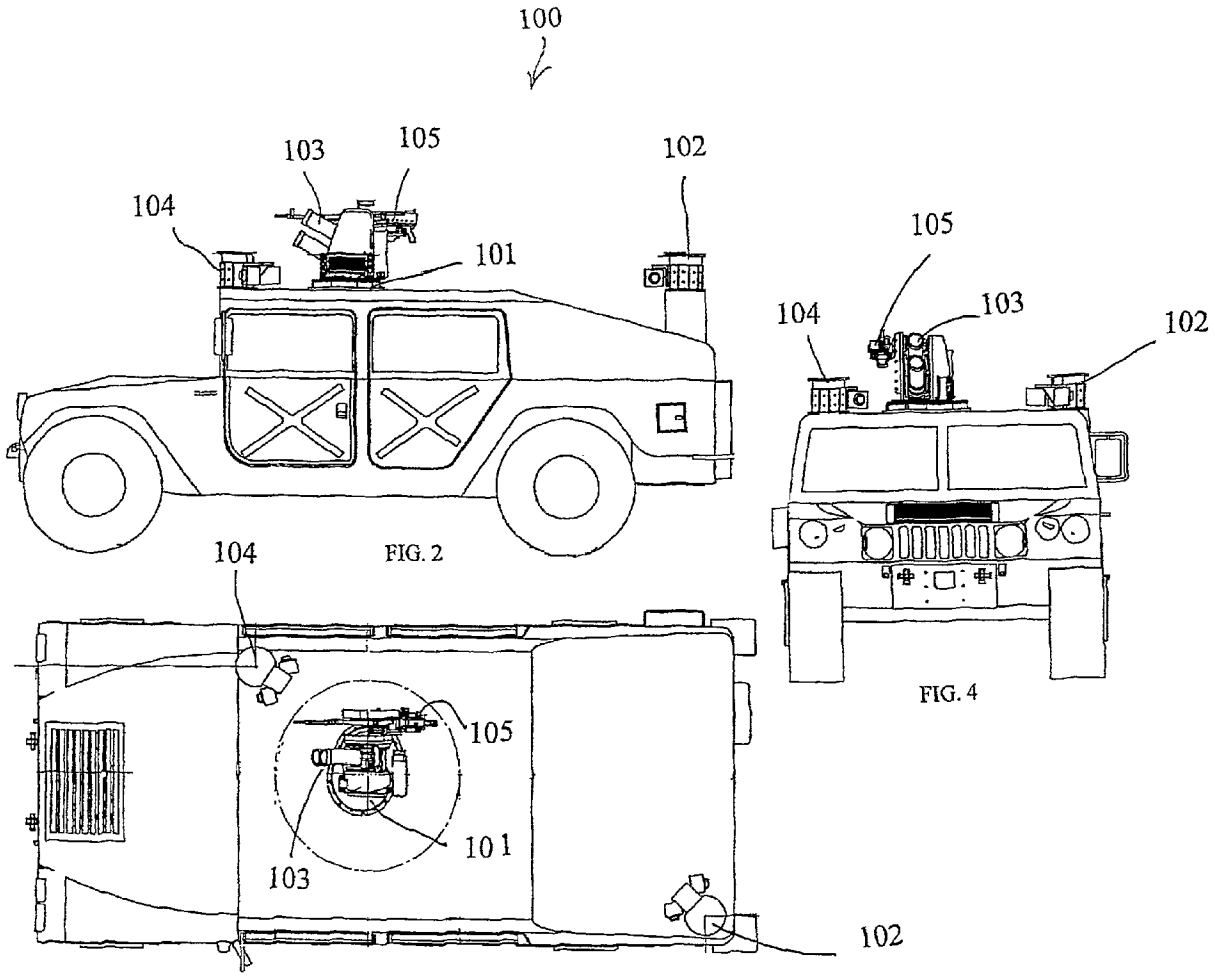
FIG. 2 is a side view of the vehicle of FIG. 1
FIG. 3 is a top view of the vehicle of FIG. 1.
FIG. 4 is a front view of the vehicle of FIG. 1.

Referring now to FIGS. 1-4 which illustrate a light military vehicle 100 equipped with a multi-weapons system 200 in accordance with the present invention. Multi-weapons system 200 is mounted on top of the vehicle 100. The multi-weapons system 200 includes a rotating platform 101 on which is mounted a double barrel mortar 103 and a machine gun 105. The vehicle 100 further includes detecting devices 102 and 104 that are strategically distributed on the roof of the vehicle and together are able to view 360 degrees around the vehicle. Detecting devices 102 and 104 site and determine the range, velocity, direction and (if required) the angular position of the threat. The detecting devices may comprise a plurality of sensors such as, for instance, visible light night vision sensors, radar and IR type sensors to give desired area coverage. The information from these detecting devices is transmitted to a computer inside the vehicle that controls the launching of an interceptor from the mortar.

Figure 5:
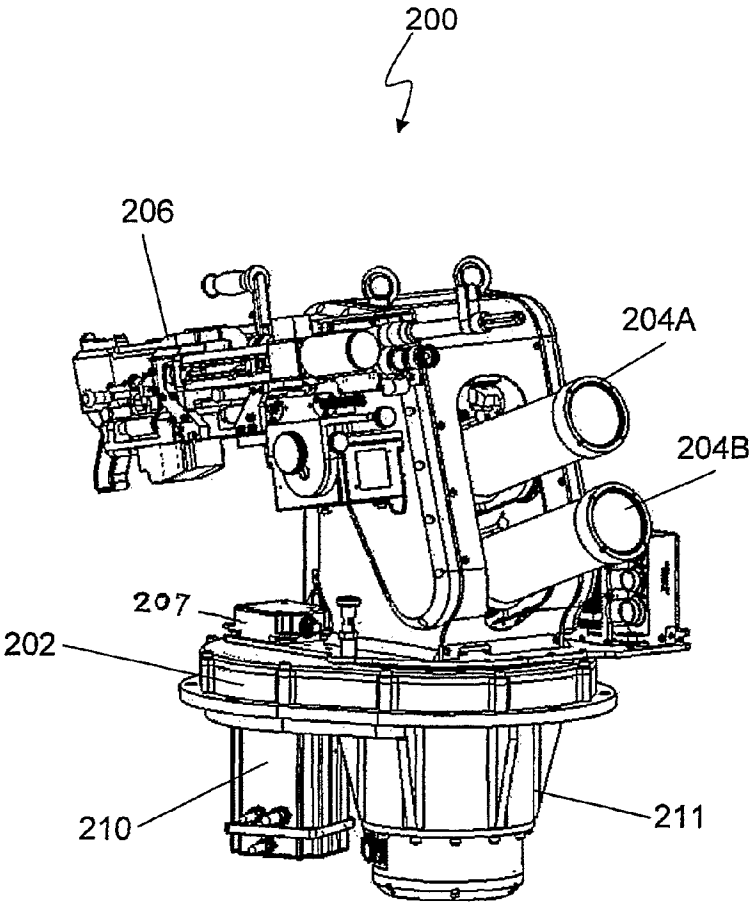
FIG. 5 illustrates a detailed perspective view of the multi-weapons system.
Figure 6:
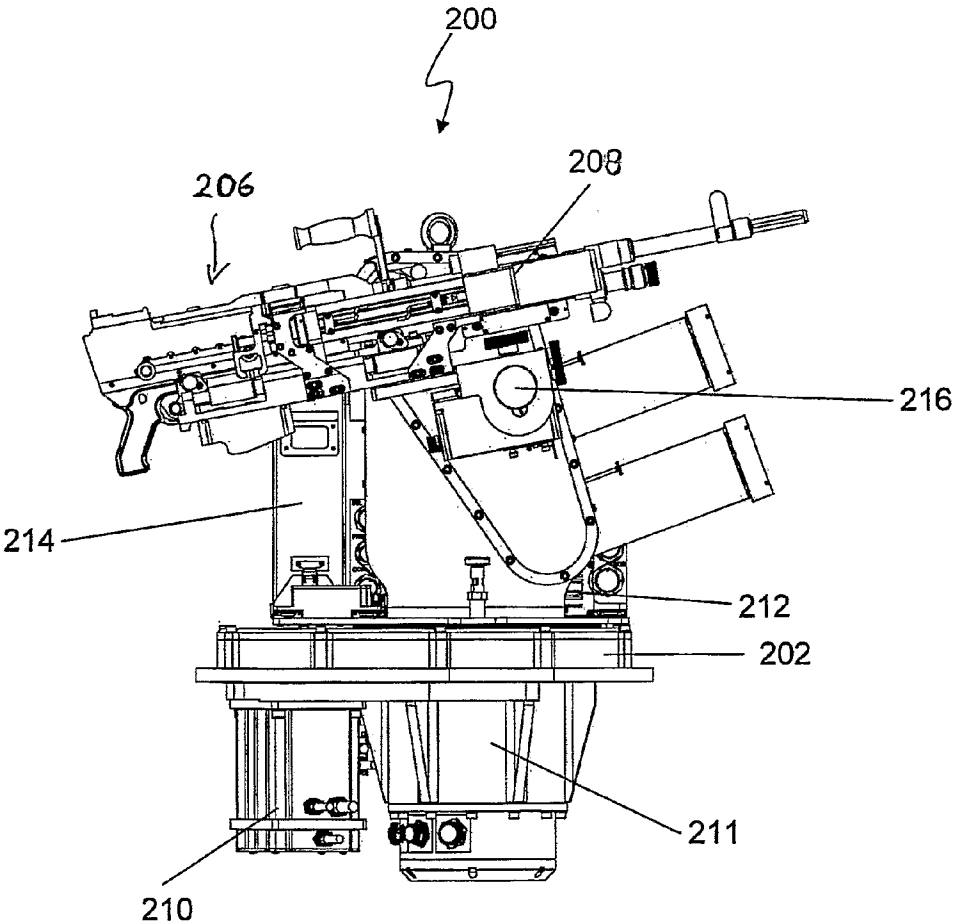
FIG. 6 illustrates a side view of the multi-weapons system of FIG. 5.
Figure 7:
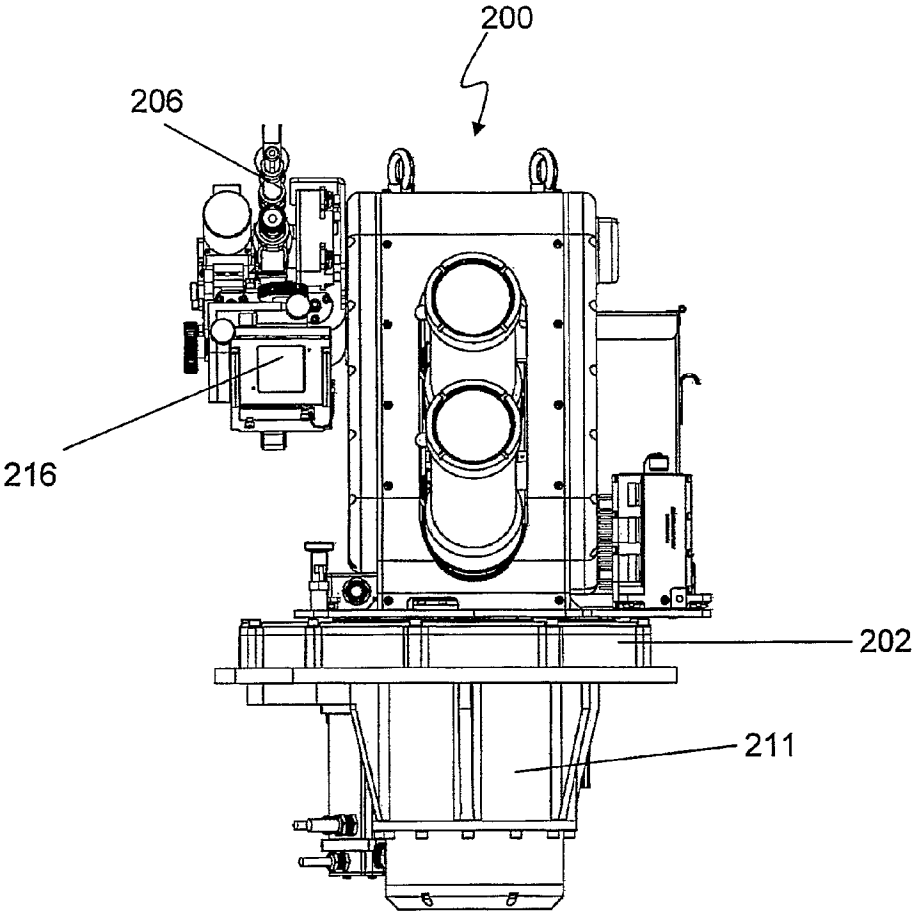
FIG. 7 illustrates a front view of the multi-weapons system of FIG. 5.

Referring now to FIGS. 5 to 7, these illustrate a detailed view of the multi-weapons system 200 in accordance with the present invention. The multi-weapons system 200 comprises a base-plate 202, an active defense system (ADS) consisting of two mortar launching tubes 204A and 204B, an angular actuators (not shown in the figure), at least one motor 210.

The multi weapons system further comprises fully-automatic or semi-automatic machine gun 206 such as, for instance, automatic canons, large, medium or small caliber guns, at least one observation device 216 positioned underneath the machine gun 206, angular actuator motor 208, an alignment device (not shown in the figure), housing 212 containing the electronics for operating the system, and an ammunition magazine 214 (seen in FIG. 6) (typically chained cartridges). Ammunition magazine 214 holds approximately between 230 and 460 bullets for the machine gun 206. The observation device 216 for the machine gun 206 can be a video camera with night vision, periscope or other imaging system allowing the remote operator viewing the target by day or night and aligning the direction of the of the firing line.

The multi-weapons system 200 further comprises a single strong electric motor 210 connected to a driver (not shown in the figure) that is used for alternating the power capacity of motor 210, i.e., between a first power capacity, and a second power capacity. The motor 210 and rotating mechanism 211 are located under the roof of the vehicle. The first power capacity is relatively high for rotating supporting base-plate 202 and multi-weapons system 200 at a first high rotational speed for firing the launching tubes 204A and 204B. The second power capacity is required for rotating the supporting base-plate 202 at a second rotational speed suitable for maneuvering the machine gun 206 at a much slower speed.

The multi-weapons system 200 further comprises the following elements (not shown in FIG. 5) mounted inside the vehicle near the driver's seat to allow remote operation of the system by personnel located inside the vehicle:

a safety switch to prevent an accidental discharge of the weapon, a remote control unit that includes:

a first computer for controlling the active defense system (i.e., launching tubes 204A and 204B), and a second computer for controlling machine gun 206, a visual output display, with associated circuitry, appropriate electrical connections, and control device such as a joystick or trigger to control the firing.

In accordance with embodiments of the present invention, base-plate 202 is mounted atop the roof of vehicle 100 (shown in FIGS. 1-4). Underneath base-plate 202 there is the rotating mechanism 211 operated by an electric motor 210 for rotating the base-plate 202 and multi-weapons system full 360 degree. Both the rotating mechanism 211 and the electric motor 210 are fitted into the vehicle through the roof of the vehicle 100 and are not seen from outside the vehicle. As noted earlier, the multi-weapons system 200 may have more than one mortar launching tube 204A and 204B to intercept more than one oncoming rocket, even if these come from different directions, because of the high speed of rotation of the system.

The angular position of launching tubes 204A and 204B with respect to base plate 202 is determined by a separate motor 207. Furthermore, an alignment device, typically based on gyroscopic elements is used to align and point the tubes 204A and 204B in a desired direction regardless of the alignment of the vehicle. Each one of the launcher tubes 204A and 204B can undergo elevation from −10 to +30 degrees.

Similarly, the angular position of the machine gun 206 with respect to base-plate 202 is determined by a motor which keeps the gun 206 at a desired direction regardless of the alignment of the vehicle. The machine gun 206 can undergo elevation of from −20 to +60 degrees.

The multi-weapons system 200 as contemplated in the present invention is able to intercept two oncoming rockets at the same time by virtue of the two launchers 204A and 204B and the fact that they can be rotated 360 degrees almost instantly. Furthermore, the multi-weapons system 200 is able to identify the direction from which a rocket is fired by virtue of the detecting devices 102 and 104, and the stabilized weapon system 200 is then activated to target that position. It should be noted that the multi-weapons system of the present invention can identify quickly and precisely the source of the threat even in highly crowded areas and aim in that direction.

To overcome the weapon system's relatively high inertia, of about 6 Nm, and to allow fast rotation of base-plate 202 with the multi-weapons system 200, the motor 210 has to be relatively large. However, while such fast rotational movement is crucial for rotating the active defense system, a slower rotational movement is desired for finely rotating and adjusting the position of machine gun 206. To keep the dimensions as well as the weight of the system to a minimum while using only a single motor 210 for both, rotating at high speed the mortar launch tubes 204A and 204B and at low speed the machine gun 206, the motor 210 is controlled by a driver connected to a first computer controlling the active defense system and to a second control computer controlling the machine gun 206. The driver alternates the power capacity of the motor to rotate the support base-plate structure 202 with the multi-weapons system 200 at a first relatively fast rotational speed and at a second slower rotational speed in the range of up to 2 radian/second.

One of the key characteristics of the multi-weapons system 200 of the present invention is that it provides a multi-weapons system, both active and conventional, for light tactical military vehicles with superior performance characteristics, something not easily achievable. The fast acting active protection system of the present invention excels in overcoming inertia.

Known systems that are comparable in weight and inertia to the system of the present invention require approximately 10 ms following a danger signal before they move. In contrast, the active protection system of the present invention responds much faster. The fact that the machine gun is added to the active defense system shifts the center of gravity of the entire weapon system requiring greater power to rotate the system to overcome the inertia.

Operating the System

The detection devices 102 & 104 continuously check for oncoming threats, and the entire multi-weapons system 200, i.e., both the active defence system (launching tubes 204A and 204B) and machine gun 206 are controlled initially by the gunner sitting inside the vehicle 100.

As soon as the detection devices 102 & 104 sight an oncoming missile or rocket, the active defence system is no longer controlled by the gunner, but becomes automated. A first computer (i.e., the computer of the active defence system) automatically activates a driver for the motor to rotate the base-plate 202 with the multi-weapons system 200 at high speed and directs the mortar launching tubes 204A and 204B to fire interceptors towards the threat to avoid being hit.

Once the base plate is rotated with the weapons, i.e., both the mortar launching tubes 204A and 204B and machine gun 206 to face the source of the danger, the gunner can use a second control computer in the vehicle to adjust the motor 210 to the second (lower) power capacity suitable for finely maneuvering and directing the machine gun to the source of the threat.

As soon as the threat is hit, control over the active defence system (launching tubes 204A and 204B) returns to the gunner sitting inside the vehicle 100.

It should be noted that in case the observation devices 102 & 104 sight an oncoming missile or rocket while machine gun 201 is firing, the firing will be stopped and the active defence system will automatically take over control and rotate the weapons on the base-plate 202.

It should be noted that these activities are all controlled by software and hardware that enable the ADS reaction time of fractions of a second to intercept a second missile as well with the second launching tube.

It should also be noted that due to the fact that the threat is sighted very fast and the active defence system (i.e., the launching tubes 204A and 204B) and machine gun 206 are mounted on a single base-plate 202 that rotates and directs the launching tubes 204A and 204B and the machine gun 206 towards the threat simultaneously exceedingly fast, the source of the threat is attacked instantly without the enemy having time to flee. This reduces number of projectiles that have to be fired to counter the threat, as compared to prior-art systems and reduce the threat of collateral damage such as fragments hitting civilians and friendly personnel in the area.

It should be further noted that besides the stability of the vehicle, the use of a mortar-like interceptor avoids having any hot exhaust gases that can cause damage to the various optic systems of the multi-weapons system.

The invention claimed is:

1. A multi-weapons system comprising:

an active defence system (ADS) comprising a mortar launch tube mounted on a support base-plate rotatable 360 degrees;

a weapons system comprising a machine gun mounted alongside the active defence system (ADS) on the support base, a motor with mechanism to rotate the support base-plate with the active defence system (ADS) 360 degrees, drive means to adjust the power capacity of the motor between that required for the active defence system (ADS) and that required for the machine gun, control means to rotate and adjust the elevation of the launch tube and adjust the directional movement of the machine gun, computer and electronic means to automatically rotate and fire the active defence system (ADS)

display and control means to manually operate the machine gun, control means to override the manual operation of the machine gun and prevent its firing when the active defence system is automatically activated.

2. A multi-weapons system in accordance with claim 1, comprising threat detecting means and means to coordinate any threat detected with the active defence system to respond to the thread.

3. A multi-weapons system in accordance with claim 1, wherein said motor is an electric motor.

4. A multi-weapons system in accordance with claim 1, activating automatically the active defence system when a threat is detected.

5. A multi-weapons system in accordance with claim 1, wherein said active defence system comprising two mortar launch tube.

6. A multi-weapons system in accordance with claim 1, wherein the mortar launch tube can undergo an elevation of from −10 to +30 degrees.

7. A multi-weapons system in accordance with claim 1, wherein the machine gun can undergo an elevation of from −20 to +60 degrees.

8. A multi-weapons system in accordance with claim 1, wherein said multi-weapons system is mounted atop the roof of a military vehicle.

9. A multi-weapons system in accordance with claim 1 comprising threat detection means comprising sensors selected from visible light sensors, IR sensors, radar and video cameras.

10. A multi-weapons system in accordance with claim 9, wherein said threat detection means are strategically distributed on a light armoured vehicle.

11. A multi-weapons system in accordance with claim 10, wherein the said threat detection means are can detect threats within 360 degrees.

12. A multi-weapons system in accordance with claim 1, wherein the rotational speed of operating the machine gun is in the range of 2 radian/second.

13. A multi-weapons system in accordance with claim 1, wherein said machine gun uses ammunition in the form of chained cartridges.

14. A multi-weapons system in accordance with claim 1, wherein said machine gun comprises at least one observation device selected from video camera, periscope, night vision device.

15. A multi-weapons system in accordance with claim 1, wherein said multi-weapon system further comprises a safety switch to deactivate the system.

16. A multi-weapons system in accordance with claim 1, wherein said multi-weapon system further comprises a remote control unit situated inside a military vehicle.

* * * * *